US005984363A

United States Patent [19]

Dotson et al.

[11] Patent Number: 5,984,363

[45] **Date of Patent: *Nov. 16, 1999**

[54] BUSINESS RECORD HAVING A THERMALLY IMAGABLE SURFACE

[75] Inventors: Mark Dotson; Rajendra Mehta; A. Dale Lakes, all of Dayton, Ohio

[73] Assignee: The Standard Register Company, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/235,543

[22] Filed: Apr. 29, 1994

Related U.S. Application Data

[63] Continuation-in-part of application No. 08/055,576, May 3, 1993, abandoned.

[51] Int. Cl.[6] ..... B42D 15/00

[52] U.S. Cl. ..... 283/61; 283/81; 283/114; 283/903; 283/904; 428/913; 503/200; 503/204; 503/216

[58] Field of Search ..... 283/61, 81, 114, 283/904, 903, 94, 95; 503/200, 204, 216; 428/913

[56] References Cited

U.S. PATENT DOCUMENTS

| | | | |
|---|---|---|---|
| 2,235,791 | 3/1941 | Wohlers . | |
| 2,374,862 | 5/1945 | Green . | |
| 3,924,049 | 12/1975 | Truitt et al. | 430/269 |
| 4,010,292 | 3/1977 | Shackle et al. | 428/914 |
| 4,109,047 | 8/1978 | Fredrickson | 283/70 X |
| 4,197,346 | 4/1980 | Stevens | 428/914 |
| 4,334,771 | 6/1982 | Ryan, Jr. | 283/117 |
| 4,427,985 | 1/1984 | Kikuchi et al. | 283/61 X |
| 4,577,204 | 3/1986 | Shibata et al. | 283/114 X |
| 4,577,205 | 3/1986 | Shibata et al. . | |
| 4,627,641 | 12/1986 | Kawaguchi . | |
| 4,638,340 | 1/1987 | Iiyama et al. | 503/204 |
| 4,662,651 | 5/1987 | Mowry, Jr. | 283/95 X |
| 4,663,641 | 5/1987 | Iiyama et al. | 503/204 |
| 4,665,410 | 5/1987 | Iiyama et al. | 503/204 |
| 4,814,319 | 3/1989 | Matsumoto et al. | 428/913 |
| 4,818,742 | 4/1989 | Ellis | 503/201 |
| 4,833,122 | 5/1989 | Doll et al. | 283/81 |
| 4,846,503 | 7/1989 | Strauss | 283/114 X |
| 4,851,383 | 7/1989 | Fickenscher et al. | 503/200 |
| 4,855,277 | 8/1989 | Walter | 428/913 |
| 4,861,748 | 8/1989 | Saeki et al. | 503/216 |
| 4,861,749 | 8/1989 | Satake et al. | 503/216 |

(List continued on next page.)

FOREIGN PATENT DOCUMENTS

| | | | |
|---|---|---|---|
| 297705 | 1/1989 | European Pat. Off. . | |
| 229095 | 9/1990 | Japan | 283/95 |
| 2163562 | 2/1986 | United Kingdom . | |
| 8906191 | 7/1989 | WIPO . | |

OTHER PUBLICATIONS

Reprint from State of the Electronic Printing Market, vol. III, Xplor, 9th Annual Conference, Nov. 13–18, 1988, p. 112.

Burke et al, "Automating Management Information Systems", *Bar Code Engineering and Implementation,* vol. 2, pp. 65, 247, 248.

*Xplor International Glossary,* 1995 Ed., p. 198.

*Primary Examiner*—Willmon Fridie, Jr.
*Assistant Examiner*—Monica Smith
*Attorney, Agent, or Firm*—Killworth, Gottman, Hagan & Schaeff, LLP

[57] ABSTRACT

A thermally imagable business record such as a form, tag, label or the like is provided in which selected areas of the record may be activated to form an image upon exposure to heat. In one embodiment, at least one selected area of a substrate surface contains a thermally imagable coating of initially colorless color formers and color developers while the remaining areas of the substrate are left uncoated. The substrate may be pre-coated to provide a smooth, non-porous base coat for the thermally imagable coating, and may also include a protective coating layer to protect the subsequently printed thermal image.

11 Claims, 2 Drawing Sheets

U.S. PATENT DOCUMENTS

| | | | |
|---|---|---|---|
| 4,865,939 | 9/1989 | Usami et al. | 503/200 |
| 4,894,359 | 1/1990 | Ueno et al. | 503/216 |
| 4,898,849 | 2/1990 | Kang | 503/200 |
| 4,918,046 | 4/1990 | Akutsu et al. | 503/216 |
| 4,921,535 | 5/1990 | Nachbur et al. | 503/216 |
| 4,962,079 | 10/1990 | Matsumoto et al. | 503/200 |
| 4,981,835 | 1/1991 | Iwakura et al. | 503/209 |
| 5,001,104 | 3/1991 | Morita et al. | 503/200 |
| 5,039,652 | 8/1991 | Doll et al. | 283/101 |
| 5,045,523 | 9/1991 | Funae et al. | 503/207 |
| 5,047,383 | 9/1991 | Hayashi et al. | 503/200 |
| 5,057,154 | 10/1991 | Kusakata et al. | 503/218 |
| 5,066,634 | 11/1991 | Minami et al. | 503/209 |
| 5,083,816 | 1/1992 | Folga et al. | 283/81 |
| 5,120,702 | 6/1992 | Minami et al. | 428/336 |
| 5,209,515 | 5/1993 | Dotson et al. | 283/95 |
| 5,239,314 | 8/1993 | Abber et al. | 380/18 |
| 5,282,651 | 2/1994 | Alonso | 283/95 X |
| 5,288,107 | 2/1994 | Johnson et al. | 283/81 |
| 5,292,713 | 3/1994 | Stenzel et al. | 503/200 |
| 5,366,087 | 11/1994 | Bane | 206/459.5 |
| 5,401,060 | 3/1995 | Chang et al. | 283/94 X |
| 5,427,415 | 6/1995 | Chang | 283/94 X |
| 5,462,909 | 10/1995 | Lakes et al. | 503/201 |

BUSINESS RECORD HAVING A THERMALLY IMAGABLE SURFACE

CROSS REFERENCE TO RELATED APPLICATION

This application is a continuation-in-part of commonly assigned U.S. patent application Ser. No. 08/055,576 filed May 3, 1993, now abandoned.

BACKGROUND OF THE INVENTION

This invention relates to a thermally imagable business record, such as a form, label, tag, or the like, in which a selected area may be activated to form a thermal image. More particularly, the invention relates to a substrate containing a thermally imagable coating on at least one selected area of its surface while the remaining areas of the substrate are left uncoated.

In the field of product labeling, direct thermal printing has been a well-known means of non-impact printing. Direct thermal printers are capable of forming images by the application of heat to a substrate containing heat-reactive chemicals thereon. Typically, a substrate such as paper is coated with a coating of color forming and color developing reactants, which, when heated, combine to form a visible image. When such a coated substrate passes under the print head of a thermal printer, the areas containing the coating are activated by the heated print elements, forming images on the surface of the substrate.

Thermally imagable coatings provide a convenient method of providing computer generated data such as bar codes or serial numbers. Such information may be printed on business forms such as labels or tags. Thermally coated substrates have also been widely used as facsimile paper, bar code paper for point-of-sale (POS) systems, automatic ticket vending machines, and labels for food products. There are various compositions and methods of applying thermally sensitive coatings as described, for example, in U.S. Pat. Nos. 4,865,939, 4,861,749, and 4,894,359.

However, while the use of thermally imagable coatings is a convenient method of providing a printable surface, the present method of applying the coatings is to cover the surface of the substrate completely. This method is both expensive and wasteful as the thermally imagable coating is applied to areas of the substrate which are not subsequently imaged.

Further, as the application of thermally sensitive coatings requires sophisticated coating equipment and techniques, it has heretofore been impractical to apply the coatings only in selected areas or to apply the coatings at the same time a business record is manufactured. Additionally, as thermally imagable coatings are typically applied to a high volume of substrates which are widely distributed for different end uses, manufacturers have produced fully coated webs or sheets to accommodate the greatest number of end uses of the products.

Accordingly, there is still a need in the art for a thermally imagable business record, such as a form, label or the like, in which a thermally imagable coating may be applied in a cost effective manner to a selected area or areas of the form so that information is printed through the use of a thermal printer only at desired locations.

SUMMARY OF THE INVENTION

The present invention meets that need by providing a business record such as a form, label, or tag having a thermally imagable coating of initially colorless color formers and color developers on selected areas which may be activated to produce a visible image when imaged in a thermal printer. The thermally imagable coatings may be applied in a cost effective manner by the manufacturer of the form, label, or tag on a selected area or areas, or on the entire surface of the form, at the same time other routine operations are performed such as preprinting information on the form or die-cutting the form to produce labels or tags.

In accordance with one aspect of the invention, an imagable business record such as a form, label or tag is provided comprising a substrate such as a sheet having first and second major surfaces. Preferably, the substrate includes a thermally imagable coating of initially colorless color formers and color developers on at least one selected area of the first surface, with the remaining areas of the substrate not containing the thermally imagable coating.

The color formers and color developers combine upon exposure to heat from a thermal print head to form visible images on the substrate including symbols, indicia, or the like. Preferably, the color formers comprise initially colorless leuco dyes, while the color developers preferably comprise acidic phenolic compounds or resins. The color formers and developers are preferably separately prepared as dispersed solids in water and then blended together. Exposure of the coating to heat causes selected reactants to melt, permitting the color former and color developer to mix and react.

While it is possible to coat the substrate in a number of different areas so that multiple thermal images are formed when the substrate is passed through a thermal printer, it is also possible to coat only one selected area of the substrate. For example, if a bar code is to be thermally imaged on a label, the coating may be applied to one section of a label where the bar code is to be printed. The coating may also be applied to a form, label, tag or the like in a number of different patterns, depending on the desired end use.

In a preferred embodiment of the invention, the substrate is pre-coated to provide a smooth and non-porous base coat for the thermally imagable coating. The base coating may be applied to the entire surface of the substrate or only to the selected area of the substrate which is to receive the thermally imagable coating. The base coating may comprise any suitable water-based, solvent-based, or ultraviolet radiation or electron beam cured polymer.

In another preferred embodiment of the invention, a protective coating is provided over the area or areas containing the thermally imagable coating to provide the subsequently printed thermal images with resistance to solvents, abrasion and fading due to exposure to light. The protective coating may be applied as a blend of electron beam curable oligomers and monomers, as a crosslinkable, water-based film forming prepolymer, or as a blend of ultraviolet radiation curable oligomers and monomers and a photocatalyst. The coatings are then cured or crosslinked to polymerize them.

In an alternative embodiment of the invention, the substrate containing the thermally imagable coating comprises a series of labels where the second surface of the substrate is coated with an adhesive. The adhesive may be a permanent or repositionable pressure sensitive adhesive, a hot melt adhesive, or other suitable adhesive. A release liner is preferably adhered to the pressure sensitive adhesive so that the series of labels may be fed through a thermal printer for imaging.

In yet another embodiment of the invention, a continuous web for producing a series of thermally imagable business forms such as labels or tags is provided. The continuous web preferably includes first and second major surfaces, with the first surface of the web including a series of individual business records such as forms, tags, or labels, with each record including at least one selected area having a thermally imagable coating of initially colorless color formers, and the remaining areas of the individual records left uncoated. The web may also include on its second surface an adhesive. Where a pressure sensitive adhesive is used, the adhesive is covered by a release liner.

The present invention also provides a method of making a thermally imagable business record which includes the steps of printing indicia on selected portions of the first surface of the substrate and applying to at least one selected area of the substrate a thermally imagable coating of initially colorless color formers and color developers, leaving the remaining areas of the substrate uncoated. Alternatively, because the thermally-imagable coating of the present invention is applied as a high-solids content ink, the coating may be applied by conventional letterpress or flexographic printing equipment.

In a preferred embodiment, the method includes the step of pre-coating the first surface of the substrate to provide a smooth and non-porous base coat prior to applying the thermally imagable coating. The method also preferably includes the step of applying a protective coating layer over the thermally imagable coating and then curing the coating. The coating may comprise a blend of electron beam curable oligomers and monomers, a crosslinkable, water-based film forming prepolymer, or a blend of ultraviolet radiation curable oligomers and monomers and a photocatalyst. The coatings are then cured or crosslinked to polymerize them.

In an alternative embodiment, the thermally imagable coating is applied to a series of areas on the substrate. The substrate is then die cut to form a series of labels. Preferably, the second surface of the substrate is coated with a pressure sensitive adhesive, and a release liner is adhered to the pressure sensitive adhesive.

Accordingly, it is a feature of the present invention to provide a thermally imagable business record such as a form, label, tag, or the like having on a selected area or areas of its surface a thermally imagable coating which may be activated to produce a visible image when imaged in a thermal printer. Other features and advantages of the invention will be apparent from the following description, the accompanying drawings, and the appended claims.

DETAILED DESCRIPTION OF THE PREFERRED EMBODIMENTS

Figure 1:
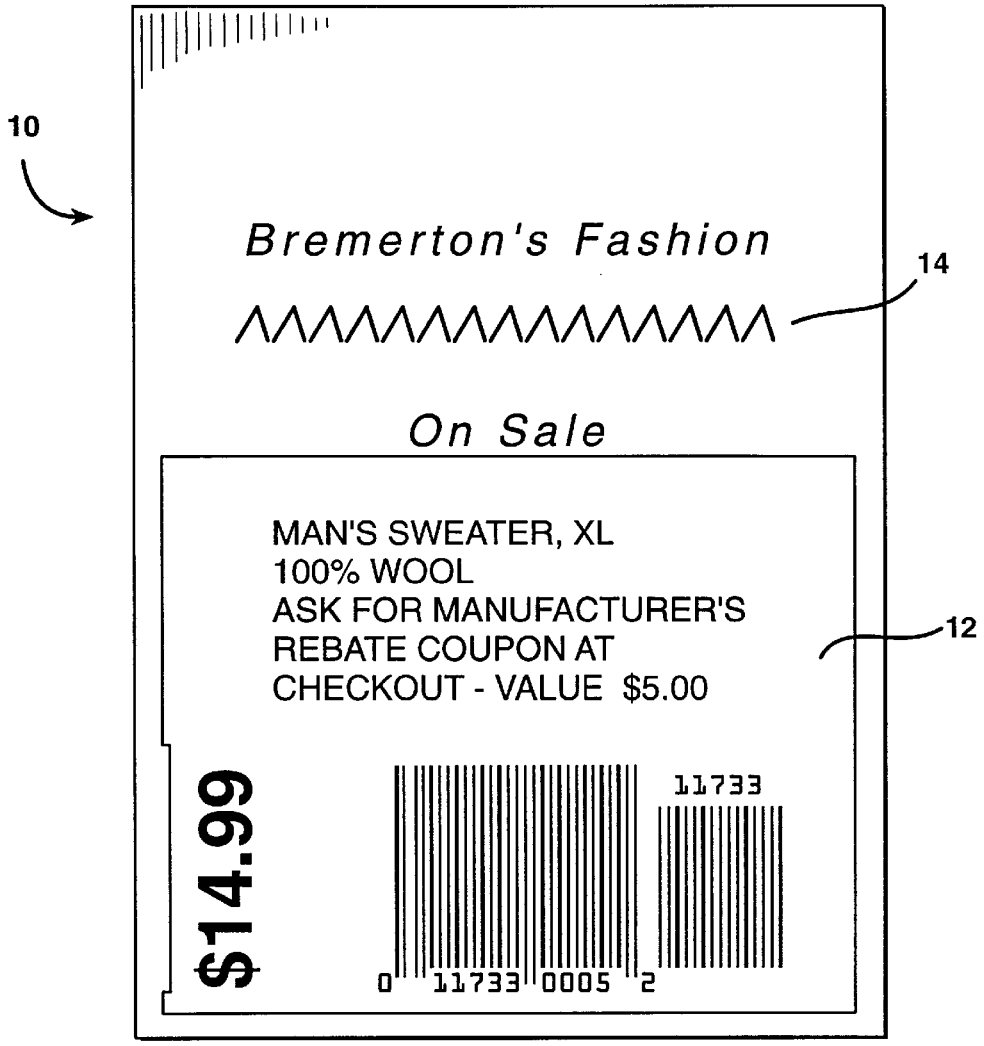
FIG. 1 is a plan view of a label having on a selected area of its surface a thermally imagable coating in accordance with the present invention.

The thermally imagable coating of the present invention may be applied to any document or record including business forms, labels, tags, or other documents in which it is desirable to selectively designate thermally imagable areas. The document may be paper or other printable material including plastic or synthetic fiber web or sheet material normally used for labels, tags, forms, etc.

Suitable color formers for use in the present invention include colorless chromogenic dye precursors known in the art such as triphenyl methanes, diphenyl methanes, leuco dyes, xanthene compounds, thiazene compounds, and spiropyran compounds such as those described in U.S. Pat. No. 5,102,856, incorporated herein by reference. Many different shades or hues of color may be produced on a document by combining color formers which form blue, yellow, green and red colors. Black images may also be produced by using a combination of color formers. Preferred for use in the present invention are leuco dyes prepared as a dispersion in water containing 45 to 55% solids. Preferably, the color formers comprise from about 4 to 18% by weight of the coating formulation.

The color developers may be selected from acidic color developers known in the art such as zinc salicylate, acetylated phenolic resins, salicylic acid modified phenolic resins, zincated phenolic resins, novolac type phenolic resins, and other monomolecular phenols such as bisphenol A 4,4'-isopropylidene diphenol, 4,4'-sulfonyl diphenol,p,p'(1-methyl-n-hexylidene) diphenol,p-tert-butyl phenol, and p-phenyl phenol. A preferred color developer is bis(3-allyl-4-hydroxyphenyl) sulfone, which is prepared as a dispersion in water containing 45 to 55% solids. The color developer is preferably present in the coating formulation from about 15 to 30% by weight.

In addition, the thermally imagable coating contains from about 15 to 25% by weight of a sensitizer. Such sensitizers are low melting point solids which, when subjected to heat, melt and become solvents for the color forming and developing reactants. Suitable sensitizers include B-naphthol benzyl ether,p-benzyl biphenyl,ethylene glycol-m-tolyl ether,m-Terphenyl,Bis [2(4-methoxy) phenoxy]ether, and dibenzyl oxalate.

A binder is also included in the coating formulation to improve the rheological properties of the coating for better printability and to promote good adhesion of the coating to the sheet surface. Suitable binders include starch, casein, polyvinyl alcohol, polyvinyl pyrrolidone, acrylamide/acrylate copolymers, carboxylated styrene butadiene latex, styrene acrylic latex, and mixtures thereof. Preferred for use in the present invention is a starch solution in water containing 10–55% solids, and a solution of a water soluble polymer or copolymer in water containing 30–35% solids. The starch solution comprises 15–35% by weight of the coating, and the polymer solution comprises 5–20% by weight of the coating.

The thermally imagable coating is preferably applied to the business record substrate by flexographic, letterpress, or gravure printing techniques. However, any suitable coating or printing process may be used including direct gravure or screen processes. The coating may be applied in selected areas so as to form images, symbols, stripes, and the like when passed through a thermal printer. The coating is preferably applied at a dry coating weight of between about 0.50 and 2.50 lbs/17"×22"×500 sheet ream (1.9 to 9.5 gm/m$^2$), and may be selectively printed or coated on the surface of stock papers during the manufacturing process.

The substrate is preferably pre-coated to provide a smooth and non-porous base coat for the thermally imagable coating. The base coat comprises any suitable water-based, solvent-based, or ultraviolet light or electron beam curable polymer which may be applied in liquid form. Examples of such suitable base coating compositions are taught in commonly-assigned published PCT International Application No. WO 90/13064, published Nov.1, 1990.

If desired, the thermally imagable coating may be overcoated with a protective coating composition which provides the subsequently printed imaged areas on the substrate with resistance to solvents, abrasion and fading from exposure to light. The protective coating may comprise a blend of electron beam curable oligomers and monomers, a crosslinkable, water-based film-forming polymer, or a blend of ultraviolet radiation cured oligomers and monomers, and a photocatalyst. A suitable ultraviolet radiation curable protective coating is disclosed in commonly assigned U.S. Pat. No. 4,999,334, incorporated herein by reference.

Referring now to the drawings, it can be seen that the thermally imagable coating may be printed on one or more selected areas of a document in a number of patterns, depending on the desired application. It should be appreciated that many different combinations for placement of the coating on a document are possible and are within the scope of this invention. Referring now to FIG. 1, a label 10 is shown comprising an substrate having first and second surfaces. The first surface of the sheet includes a selected area 12 containing a thermally imagable coating of initially colorless color formers and color developers and an uncoated area 14 which contains preprinted indicia. As shown, the thermally coated area 12 has been imaged to provide variable information as well as bar coded information on the label.

Direct thermal printers currently in use in the art include print heads or print bars with small heated elements which are individually addressable by digital input from a controlling computer. When the record is passed under the print head or print bar of a thermal printer, selected heated elements are activated and heat selected areas on the record. The coating in the selected areas is heated, causing at least one component of the coating to melt and permit the color formers and color developers to combine to form a visible color. For example, the thermal printer can be programmed to print varied information in one selected area as shown in FIG. 1.

Figure 2:
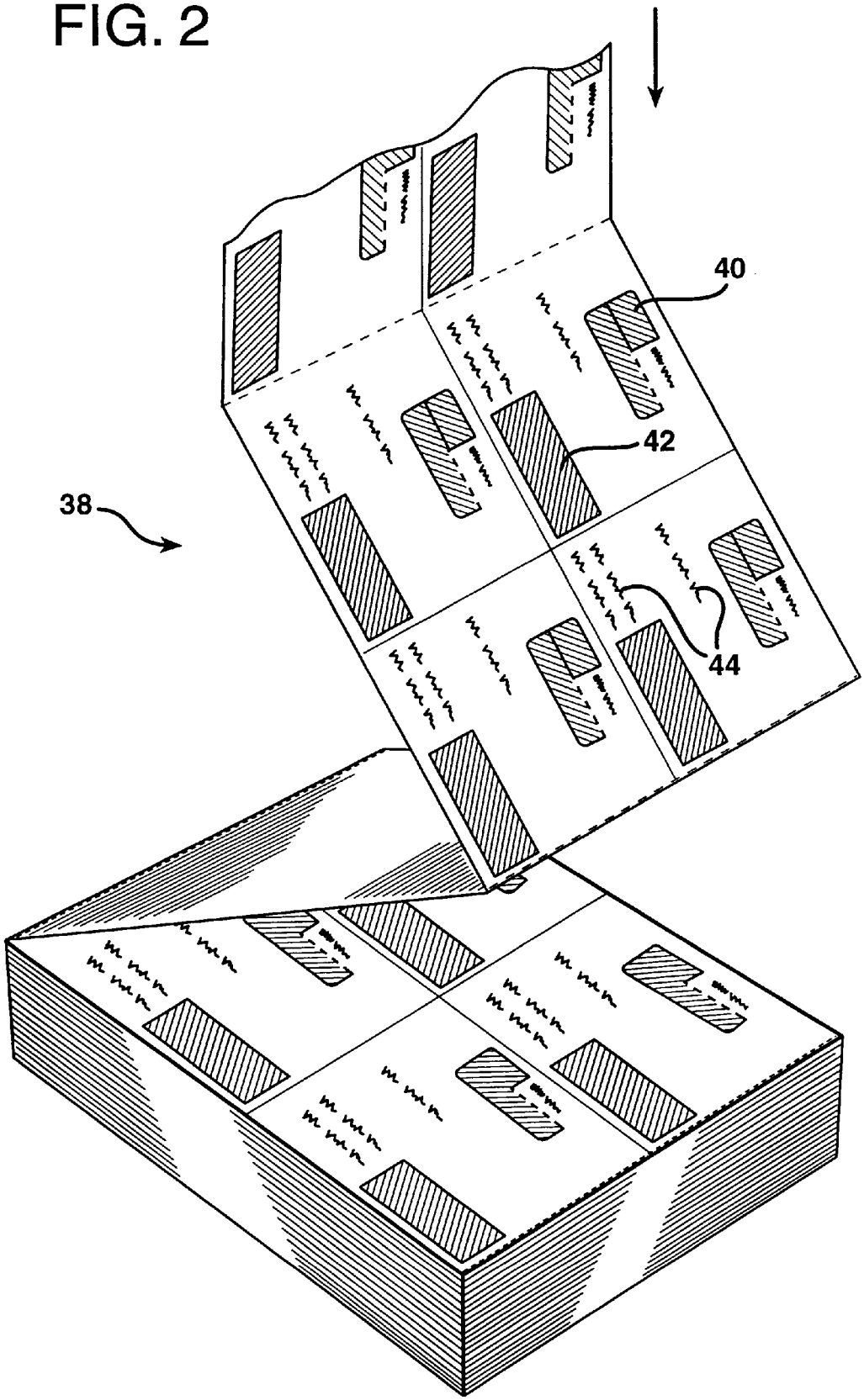
FIG. 2 is a perspective view of a continuous web of labels in accordance with the present invention.

In another embodiment of the invention illustrated in FIG. 2, a continuous form 38 is shown which contains a series of labels which are coated with the thermally imagable coating in several selected areas. If desired, the web may be preprinted with nonvariable, fixed information, or variable information by automated equipment and then printed in a selected area of areas with a thermally imagable coating in accordance with the present invention so that additional information may be imaged at a later time. For example, as shown in FIG. 2, areas 44 contain preprinted information, and areas 40 and 42 are coated with a thermally imagable coating of color formers and color developers which may be imaged at a later time to provide additional, variable information.

Figure 3:
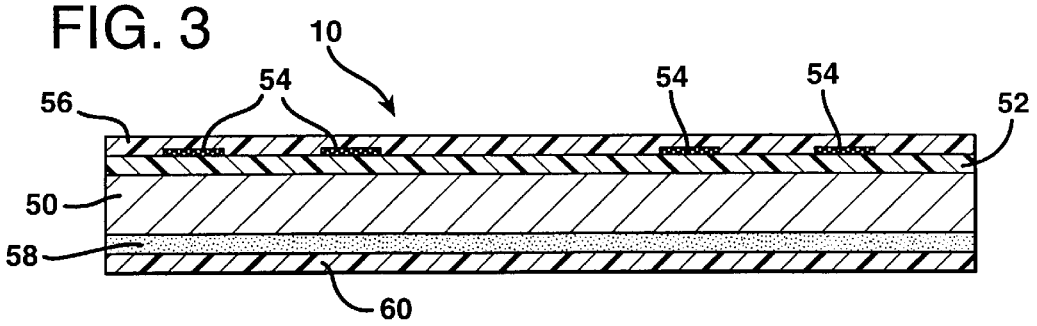
FIG. 3 is a side view in cross section of a label in accordance with the present invention.

In a preferred embodiment as shown in FIG. 3, label 10 includes a pressure sensitive adhesive 58 on its second surface. The adhesive preferably comprises a pressure-sensitive adhesive but may include any suitable adhesive such as water-based, solvent-based or hot-melt adhesives. The adhesive may be permanent or repositionable. Where a pressure sensitive adhesive is used, a release liner 60 covers the adhesive and protects it until use. As discussed above, substrate 50 of liner 10 is preferably pre-coated with a non-porous base coat 52 to provide a smooth surface for thermally imagable coatings 54. Coatings 54 may be overcoated with a protective coating 56 to provide the label with resistance to solvents and abrasion, as well as light fading.

The invention provides the significant advantage that a business form may be provided with a thermally imagable coating only in those areas which are to be subsequently imaged. In addition, the method is convenient and cost-effective because the coating is a high-solids content ink which can be applied in line at the same time other steps are being performed such as preprinting information, die-cutting labels, etc. For example, a preferred process of making the business records of the present invention includes printing fixed or variable indicia on the substrate, followed by application of the thermally imagable coating to one or more selected areas or to the entire surface of the substrate, then die-cutting the substrate, and perforating and folding the die cut labels. It is possible to apply the thermally imagable coating in the same pass in which the other operations are performed. The thermally imagable coatings may also be applied in a separate pass through coating equipment.

If desired, a plurality of different colored thermally imagable coatings may be applied in selected areas such that different colored areas are formed when the document is subsequently imaged. Such coatings may be selectively coated or printed separately on each desired portion of a document as described in commonly assigned U.S. application Ser. No. 08/055,576, filed May 3, 1993, abandoned in favor of U.S. Pat. No. 5,524,934, issued Jun. 11, 1996, incorporated herein by reference.

The uses for the present invention are many and varied. The thermally coated substrates may be produced as facsimile paper, bar code paper for point-of-sale systems, tickets for automatic vending machines, and various labels or tags. Other potential uses for the present invention will be apparent to those skilled in the art.

In order that the invention may be more readily understood, reference is made to the following example which is intended to illustrate the invention, but not limit the scope thereof.

Example 1

The following materials were combined and blended by mild agitation to produce a preferred thermally imagable coating formulation:

| | Weight % |
|---|---|
| Color former[1] | 8 |
| Color developer[2] | 13 |
| Sensitizer[3] | 12 |
| Binder[4] | 20 |
| Water | 47 |

[1]Black 305 from Nagase America
[2]Bis(3-allyl-4-hydroxyphenyl) sulfone from Nagase America
[3]P-benzyl biphenyl from Nagase
[4]Starch solution from Penford Products While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A thermally imagable business record in which a selected area may be activated to form an image comprising:

a substrate having first and second major surfaces, a thermally imagable coating of initially colorless color formers and color developers in solid form on at least one selected area of said first surface of said substrate which is less than the entire surface of the substrate, with the remaining areas of said first surface of said substrate not containing said thermally imagable coatings; wherein at least one of said initially colorless color formers and color developers are adapted to melt upon exposure to heat and combine with one another to form a visible image.

2. The thermally imagable business record of claim 1 including a protective coating layer over said thermally imagable coating.

3. The thermally imagable business record of claim 2 wherein said protective coating layer is selected from the group consisting of electron beam cured polymers, crosslinked, water-based polymers, and ultraviolet radiation cured polymers and a photocatalyst.

4. The thermally imagable business record of claim 1 wherein said thermally imagable coating has been coated as a pattern on said substrate.

5. The thermally imagable business record of claim 1 including a series of selected areas containing a coating of initially colorless color formers and color developers.

6. The thermally imagable business record of claim 5 in which different ones of said selected areas are coated to contain color formers and color developers which combine to form at least two different colors.

7. The thermally imagable business record of claim 1 comprising a continuous web for producing a series of thermally imagable business records and wherein said thermally imagable coating has been coated as a series of patterns on said web.

8. A thermally imagable business record in which a selected area may be activated to form an image comprising:

a substrate having first and second major surfaces, a thermally imagable coating of initially colorless color formers and color developers in solid form on at least one selected area of said first surface of said substrate which is less than the entire surface of the substrate, with the remaining areas of said first surface of said substrate not containing said thermally imagable coating, wherein said substrate comprises a series of labels, wherein said second surface of said substrate is coated with a pressure sensitive adhesive, and wherein at least one of said initially colorless color formers and color developers are adapted to melt upon exposure to heat and combine with one another to form a visible image.

9. The thermally imagable business record of claim 8 wherein a release liner is adhered to said pressure sensitive adhesive.

10. A thermally imagable business record in which a selected area may be activated to form an image comprising:

a substrate having first and second major surfaces, a thermally imagable coating of initially colorless color formers and color developers on at least one selected area of said first surface of said substrate which is less than the entire surface of the substrate, with the remaining areas of said first surface of said substrate not containing said thermally imagable coating; wherein said at least one selected area of said first surface of said substrate has been pre-coated to provide a smooth and non-porous base coat for said thermally imagable coating.

11. A thermally imagable business record in which a selected area may be activated to form an image comprising:

a substrate having first and second major surfaces, a thermally imagable coating comprising initially colorless color formers, color developers, and a sensitizer in solid form on at least one selected area of said first surface of said substrate which is less than the entire surface of the substrate, with the remaining areas of said first surface of said substrate not containing said thermally imagable coating, and wherein said sensitizer is adapted to melt upon exposure to heat and become a solvent for said color formers and color developers such that said color formers and color developers combine with one another to form a visible image.

* * * * *